US005461732A

United States Patent [19]

Reiman

[11] Patent Number: 5,461,732

[45] Date of Patent: Oct. 31, 1995

[54] TOILET SEAT COVER

[76] Inventor: Cassandra A. Reiman, 3239 N. Octavia Dr., Chicago, Ill. 60634

[21] Appl. No.: 299,962

[22] Filed: Sep. 2, 1994

[51] Int. Cl.[6] ..... A47K 13/14

[52] U.S. Cl. ..... 41/245.3

[58] Field of Search ..... 4/239, 245.1, 245.3, 4/245.5, 245.6, 245.7

[56] References Cited

U.S. PATENT DOCUMENTS

| | | | |
|---|---|---|---|
| 1,575,640 | 3/1926 | Ragland | 4/245.3 |
| 2,481,427 | 9/1949 | Hunter | 4/245.3 X |
| 2,706,767 | 4/1955 | Packchanian | 4/245.3 X |
| 3,587,119 | 6/1969 | Freses | 4/245.5 |
| 4,930,165 | 6/1990 | Wilson | 4/245.3 X |

FOREIGN PATENT DOCUMENTS

| | | | |
|---|---|---|---|
| 1180551 | 2/1970 | United Kingdom | 4/245.3 |

*Primary Examiner*—Charles E. Phillips

[57] ABSTRACT

A seat cover for padding a toilet seat and precluding a transmission of germs from the toilet seat to an individual. The inventive device includes an elliptical pad positionable over the toilet seat. A plurality of straps can be extended about the toilet seat and cooperate to retain the cover relative thereto. The elliptical pad is provided with folding structure which permits the cover to be compactly folded for storage and transport thereof.

5 Claims, 4 Drawing Sheets

FIG. 5
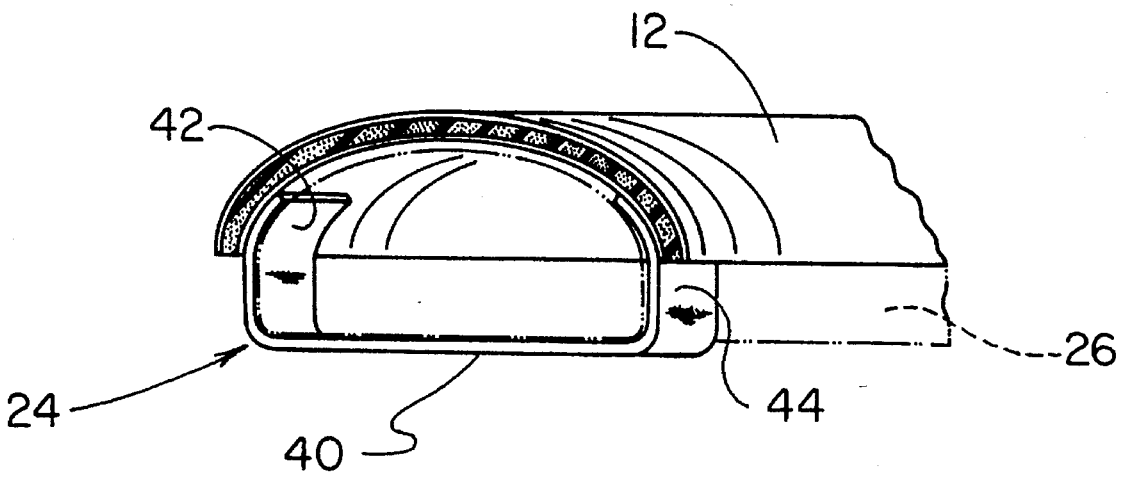
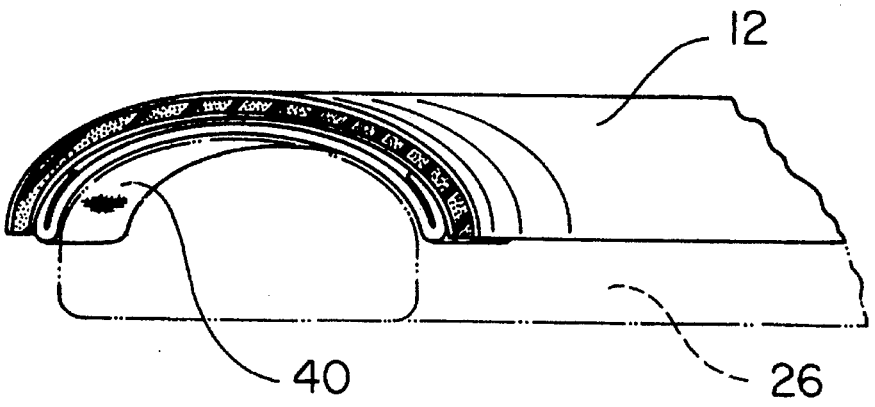
FIG. 6

TOILET SEAT COVER

BACKGROUND OF THE INVENTION

1. Field of the Invention

The present invention relates to toilet structures and more particularly pertains to a toilet seat cover for padding a toilet seat.

2. Description of the Prior Art

The use of toilet structures is known in the prior art. More specifically, toilet structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art toilet structures include U.S. Pat. Nos. 5,193,229; 4,998,297; 4,806,406; 4,412,360; and 3,587,119.

While these devices fulfill their respective, particular objectives and requirements, the aforementioned patents do not disclose a toilet seat cover for padding a toilet seat and precluding transmission of germs from the toilet seat to an individual which includes an elliptical pad positionable over the toilet seat, a plurality of straps which may be extended about the toilet seat to retain the cover relative thereto, and folding structure integrally formed within the elliptical pad for permitting the cover to be compactly folded for storage and transport thereof.

In these respects, the toilet seat cover according to the present invention substantially departs from the conventional concepts and designs of the prior art, and in so doing provides an apparatus primarily developed for the purpose of padding and insulating a toilet seat.

SUMMARY OF THE INVENTION

In view of the foregoing disadvantages inherent in the known types of toilet structures now present in the prior art, the present invention provides a new toilet seat cover construction wherein the same can be utilized for covering and padding a toilet seat to preclude both a thermal transfer of heat from an individual to the toilet seat, as well as a transmission of germs from the toilet seat to the individual. As such, the general purpose of the present invention, which will be described subsequently in greater detail, is to provide a new toilet seat cover apparatus and method which has many of the advantages of the toilet structures mentioned heretofore and many novel features that result in a toilet seat cover which is not anticipated, rendered obvious, suggested, or even implied by any of the prior art toilet structures, either alone or in any combination thereof.

To attain this, the present invention generally comprises a seat cover for padding a toilet seat and precluding a transmission of germs from the toilet seat to an individual. The inventive device includes an elliptical pad positionable over the toilet seat. A plurality of straps can be extended about the toilet seat and cooperate to retain the cover relative thereto. The elliptical pad is provided with folding structure which permits the cover to be compactly folded for storage and transport thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet seat cover apparatus and method which has many of the advantages of the toilet structures mentioned heretofore and many novel features that result in a toilet seat cover which is not anticipated, rendered obvious, suggested, or even implied by any of the prior art toilet structures, either alone or in any combination thereof.

It is another object of the present invention to provide a new toilet seat cover which may be easily and efficiently manufactured and marketed.

It is a further object of the present invention to provide a new toilet seat cover which is of a durable and reliable construction.

An even further object of the present invention is to provide a new toilet seat cover which is susceptible of a low cost of manufacture with regard to both materials and labor, and which accordingly is then susceptible of low prices of sale to the consuming public, thereby making such toilet seat covers economically available to the buying public.

Still yet another object of the present invention is to provide a new toilet seat cover which provides in the apparatuses and methods of the prior art some of the advantages thereof, while simultaneously overcoming some of the disadvantages normally associated therewith.

Still another object of the present invention is to provide a new toilet seat cover for padding a toilet seat and precluding both a thermal transfer of heat from an individual to the toilet seat, as well as a transmission of germs from the toilet seat to the individual.

Yet another object of the present invention is to provide a new toilet seat cover which includes an elliptical pad positionable over the toilet seat, a plurality of straps which may be extended about the toilet seat to retain the cover relative thereto, and folding structure integrally formed within the elliptical pad for permitting the cover to be compactly folded for storage and transport thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an additional cross-sectional view of the cover detailing the securing strap means including an elastic strap.

FIG. 6 is a further cross-sectional illustration of the elastic strap shown in an alternate position.

DESCRIPTION OF THE PREFERRED EMBODIMENT

Figure 1:
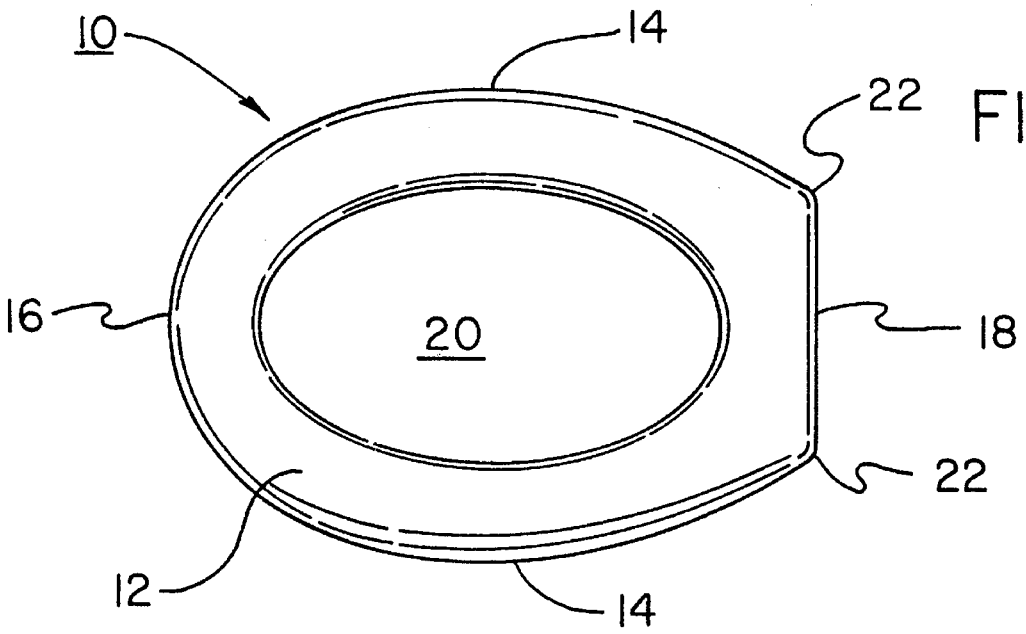
FIG. 1 is a top plan view of a toilet seat cover according to the present invention.

With reference now to the drawings, and in particular to FIGS. 1–8 thereof, a new toilet seat cover embodying the principles and concepts of the present invention and generally designated by the reference numeral 10 will be described.

Figure 2:
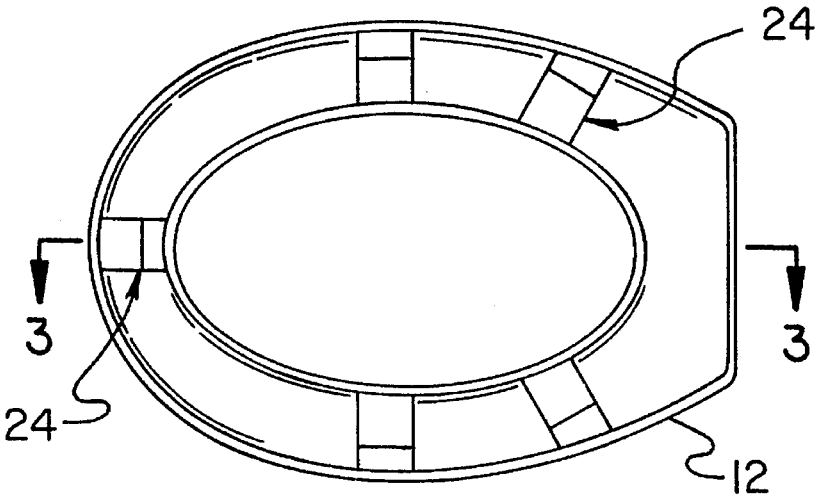
FIG. 2 is a bottom plan view of the invention.

More specifically, it will be noted that the toilet seat cover 10 comprises an elliptical pad 12 having opposed contoured sides 14 connected by a contoured front end 16 and a straight rear end 18. The elliptical pad 12 additionally includes a contoured center aperture 20 extending through a center thereof. The straight rear end 18 of the elliptical pad 12 is operable to engage or to be positioned against a toilet tank of an unillustrated associated toilet to impart rotational stability to the elliptical pad 12 relative to the toilet structure. In other words, the straight rear end 18 of the elliptical pad 12 engages the toilet, wherein a pair of angled corners 22 positioned at opposed ends of the straight rear end 18 engage the toilet tank to orient the pad 12 so as to project substantially orthogonally from the toilet tank and along the toilet seat positioned over an unillustrated toilet bowl of the toilet. As shown in FIG. 2, the present invention 10 includes a plurality of securing strap means 24 for coupling the elliptical pad 12 to a toilet seat 26.

Figure 3:
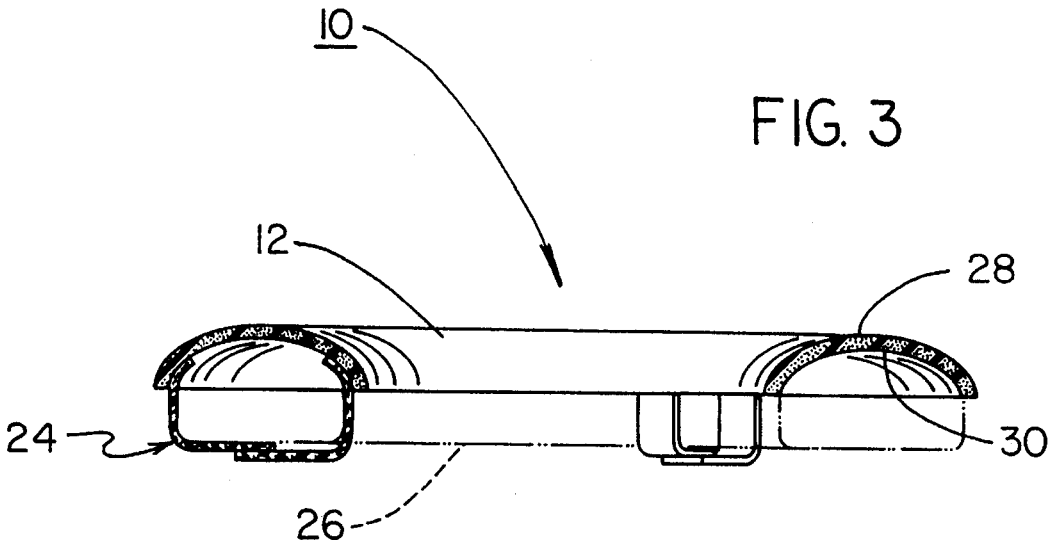
FIG. 3 is a cross-sectional view taken along line 3—3 of FIG. 2.
Figure 4:
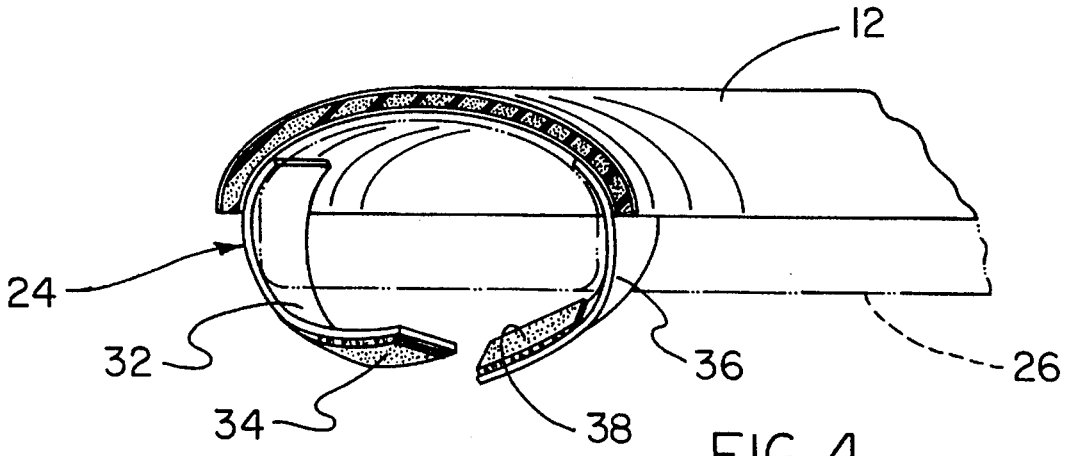
FIG. 4 is a further cross-sectional illustration of the cover.
Figure 7:
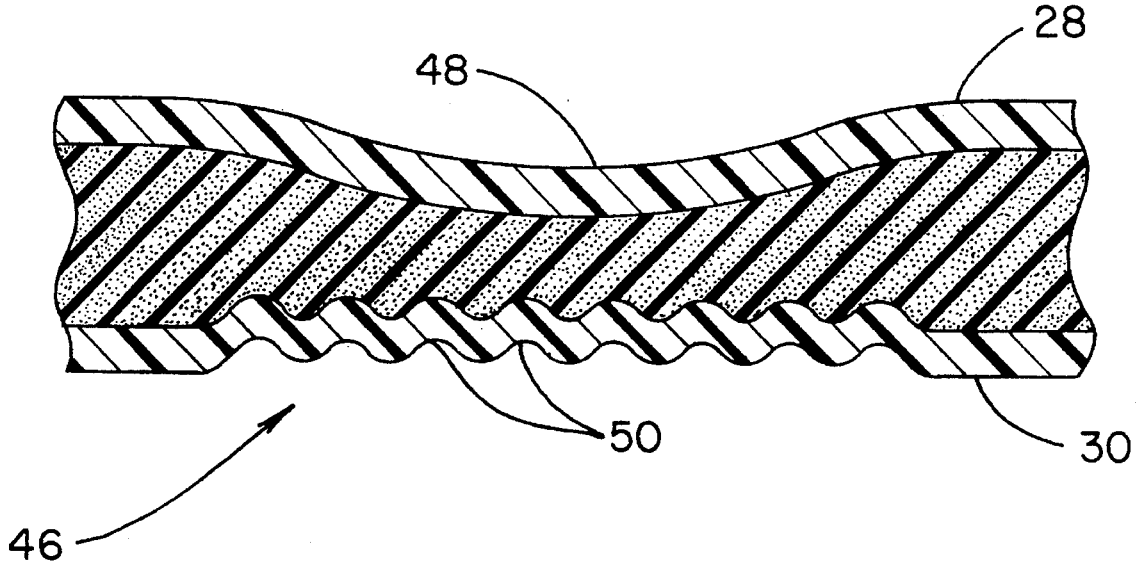
FIG. 7 is a further cross-sectional view of the elliptical pad illustrating a fold permitting means.

Referring now to FIGS. 3 and 4, it can be shown that the elliptical pad 12 is shaped so as to define a convex upper surface 28 spaced from a concave lower surface 30. The concave lower surface 30 is shaped so as to substantially follow a contour of the toilet seat 26 to which the elliptical pad 12 is attached by the securing strap means 24. To this end, and as illustrated in FIG. 4, the securing strap means 24 may comprise a first strap 32 having a first portion 34 of a fabric fastener secured to an outer distal end thereof, with an inner proximal end of the first strap being secured to an outer perimeter of the concave lower surface 30 of the elliptical pad 12. Further, a second strap 36 is secured at an inner proximal end thereof to an inner perimeter of the concave lower surface 30 of the elliptical pad 12, with a second portion 38 of the fabric fastener being secured to an outer distal end of the second strap. Thus, the first portion 34 of the fabric fastener may be selectively engaged to the second portion 38 of the fabric fastener to removably couple the first strap 32 to the second strap 36 about the toilet seat 26.

Referring now to FIGS. 5 and 6, it can be shown that the securing strap means 24 may alternatively comprise a single elastic strap 40 having a pair of opposed ends, with a first end 42 of the elastic strap 40 being coupled to the outer perimeter of the concave lower surface 30 of the elliptical pad 12, and a second end 44 being coupled to an inner perimeter of the lower surface. By this structure, the elastic strap 40 can be positioned over the toilet seat of a public restroom by simply sliding the elastic strap 40 onto the seat through the center front aperture commonly found on such public restroom toilet seats. Alternatively, the elastic strap 40 may be folded inwardly upon itself, as shown in FIG. 6, to permit placement of the elliptical pad 12 onto a toilet seat 26 not having such front aperture permitting sliding engagement of the elastic strap over the toilet seat.

Figure 8:
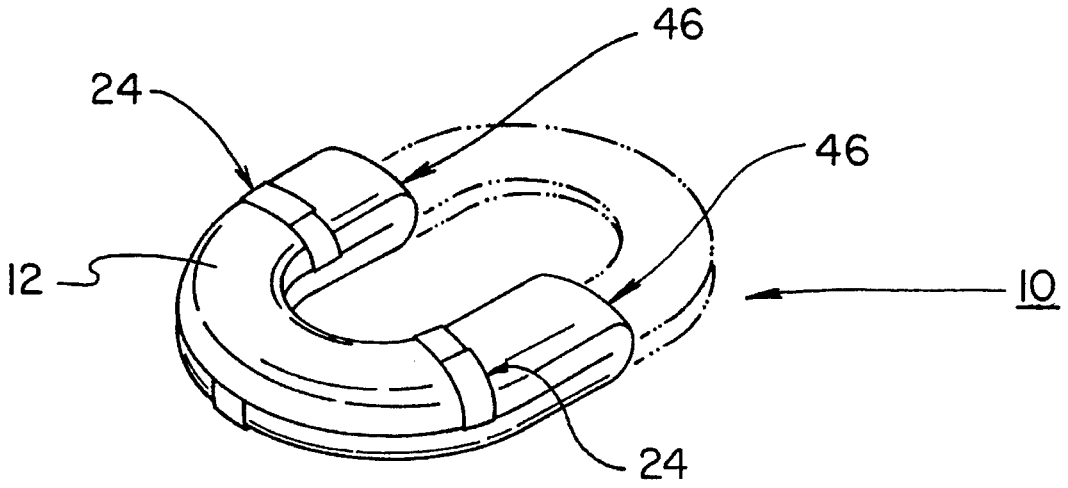
FIG. 8 is an isometric illustration of the present invention shown in a folded configuration.

The elliptical pad 12 of the device 10 is preferably constructed of a resilient foam cushion covered by the convex upper surface 28 and the concave lower surface 30. Preferably, the upper and lower surfaces 28, 30 are formed of a flexible plastic material bonded or laminated to the foam core positioned therebetween. To permit folding of the device 10 for transportation and/or storage, a fold permitting means 46 is integrally formed into the elliptical pad 12 and extends from the contoured sides 14 to connect with the center aperture 20. In other words, the fold permitting means 46 extends transversely across the lateral portions of the elliptical pad 12 to permit the device 10 to be folded as illustrated in FIG. 8. To this end, the fold permitting means preferably comprises an arcuate depression 48 formed into the upper surface 28 and correspondingly in the foam core positioned therebeneath. The fold permitting means 46 further comprises a plurality of corrugations 50 formed along the lower surface 30 and correspondingly within the foam core positioned between the upper and lower surfaces 28, 30. The fold permitting means 46 thus permits the elliptical pad 12 to be folded on top of itself, as shown in FIG. 8, wherein the strap means 24 can be utilized to retain the cover 10 and the folding configuration for travelling and/or storage purposes. Although the fold permitting means 46 has been specifically described as comprising an arcuate depression 48 formed in the upper surface 28, and a plurality of corrugations 50 formed in the lower surface 30, is within the intent and purview of the present invention to form the arcuate depression 48 within the lower surface 30 and the corrugations 50 within the upper surface 28. Regardless of the positioning of the arcuate depression 48 and the corrugations 50, i.e. formed along either the upper or lower surfaces, respectively, the arcuate depression 48 is operable to permit compression of the upper or lower surface material, wherein the corrugations 50 are operable to permit expansion of the lower or upper surface material to allow the device 10 to be folded substantially as shown.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet seat cover comprising:

an elliptical pad including opposed contoured sides connected by a contoured front end and a straight rear end having a pair of angled corners positioned at opposed ends of the straight rear end, said elliptical pad further including a contoured center aperture extending through a center thereof, with said straight rear end of said elliptical pad being operable to abuttingly engage a toilet tank of said toilet to impart rotational stability to the elliptical pad relative to said toilet such that said angled corners engage said toilet tank to orient said elliptical pad so as to project substantially orthogonally from said toilet tank and along said toilet seat, the elliptical pad being shaped so as to define a convex upper surface spaced from a concave lower surface, said concave lower surface being shaped so as to substantially follow a contour of said toilet seat;

a securing strap means comprised of a single elastic strap, with a first end of said elastic strap being coupled to an outer perimeter of said concave lower surface of said elliptical pad, and a second end of said single elastic strap being coupled to an inner perimeter of said lower surface, whereby said elastic strap can be positioned over said toilet seat by sliding said elastic strap onto said seat through a forward center front aperture of said toilet seat.

2. The toilet seat cover of claim 1, and further comprising a fold permitting means for permitting folding of said elliptical pad.

3. The toilet seat cover of claim 2, wherein said fold permitting means is integrally formed into said elliptical pad and extends from each of said contoured sides to connect with said center aperture thereof.

4. The toilet seat cover of claim 3, wherein said fold permitting means comprises an arcuate depression formed into said upper surface; and a plurality of corrugations formed along said lower surface.

5. A toilet seat cover comprising:

an elliptical pad, said elliptical pad including opposed contoured sides connected by a contoured front end and a straight rear end having a pair of angled corners positioned at opposed ends of the straight rear end, said elliptical pad further including a contoured center aperture extending through a center thereof, with said straight rear end of said elliptical pad being operable to abuttingly engage a toilet tank of said toilet to impart rotational stability to the elliptical pad relative to said toilet such that said angled corners engage said toilet tank to orient said elliptical pad so as to project substantially orthogonally from said toilet tank and along said toilet seat, said elliptical pad being shaped so as to define a convex upper surface spaced from a concave lower surface, said concave lower surface being shaped so as to substantially follow a contour of said toilet seat, said elliptical pad being constructed of a resilient foam cushion covered by said convex upper surface and said concave lower surface, wherein said upper and lower surfaces are formed of a flexible material bonded to said foam core positioned therebetween;

a plurality of securing strap means for coupling said elliptical pad to a toilet seat of a toilet, said securing strap means comprising a single elastic strap, with a first end of said elastic strap being coupled to an outer perimeter of said concave lower surface of said elliptical pad, and a second end of said single elastic strap being coupled to an inner perimeter of said lower surface, whereby said elastic strap can be positioned over said toilet seat by sliding said elastic strap onto said seat through a forward center front aperture of said toilet seat; and, a fold permitting means for permitting folding of said elliptical pad, said fold permitting means being integrally formed into said elliptical pad and extends from each of said contoured sides to connect with said center aperture thereof, said fold permitting means comprising an arcuate depression formed into said upper surface; and a plurality of corrugations formed along said lower surface.

* * * * *